US008288643B2

(12) United States Patent
Komatsu

(10) Patent No.: US 8,288,643 B2
(45) Date of Patent: Oct. 16, 2012

(54) PEDAL CONTROL APPARATUS OF ELECTRONIC KEYBOARD MUSICAL INSTRUMENT

(75) Inventor: Akihiko Komatsu, Hamamatsu (JP)

(73) Assignee: Yamaha Corporation, Hamamatsu-Shi, Shizuoka-Ken (JP)

( * ) Notice: Subject to any disclaimer, the term of this patent is extended or adjusted under 35 U.S.C. 154(b) by 75 days.

(21) Appl. No.: 12/370,153

(22) Filed: Feb. 12, 2009

(65) Prior Publication Data

US 2009/0205476 A1 Aug. 20, 2009

(30) Foreign Application Priority Data

Feb. 19, 2008 (JP) ..... 2008-037184

(51) Int. Cl.
*G10H 3/00* (2006.01)
*G10H 1/36* (2006.01)

(52) U.S. Cl. ..... 84/746; 84/610; 84/626; 84/725

(58) Field of Classification Search ..... 84/746
See application file for complete search history.

(56) References Cited

U.S. PATENT DOCUMENTS

| | | | | |
|---|---|---|---|---|
| 4,653,378 | A * | 3/1987 | Watanabe et al. | 84/423 R |
| 5,016,513 | A * | 5/1991 | Stahnke | 84/19 |
| 5,880,389 | A | 3/1999 | Muramatsu | |
| 7,002,070 | B2 * | 2/2006 | Katz | 84/718 |
| 2005/0204908 | A1 * | 9/2005 | Uehara | 84/746 |
| 2006/0021488 | A1 * | 2/2006 | Fujiwara et al. | 84/13 |

FOREIGN PATENT DOCUMENTS

| | | | |
|---|---|---|---|
| JP | 02-232695 | A | 9/1990 |
| JP | 04-057093 | | 2/1992 |
| JP | 05-188941 | A | 7/1993 |
| JP | 10-020858 | A | 1/1998 |
| JP | 2000-235392 | A | 8/2000 |
| JP | 2001-022355 | | 1/2001 |
| JP | 2004-334008 | | 11/2004 |

* cited by examiner

*Primary Examiner* — Christopher Uhlir

(74) *Attorney, Agent, or Firm* — Morrison & Foerster LLP

(57) ABSTRACT

Different kinds of control tables in which action of a pedal 4 is associated with reaction force exerted on the pedal 4 by an actuator 7 are stored in a memory of an electronic keyboard musical instrument 26. The different kinds of control tables are designed to include a half pedal range. A CPU 40 selects one of the different kinds of control tables in accordance with player's manipulation of setting operators 28 to obtain a reaction force exerted on the pedal 4 by the actuator 7 from the selected control table, the reaction force being associated with an action detected by an action detecting portion 6. The CPU 40 also controls the actuator 7 such that the actuator 7 exerts the obtained reaction force on the pedal 4.

15 Claims, 10 Drawing Sheets

PEDAL CONTROL APPARATUS OF ELECTRONIC KEYBOARD MUSICAL INSTRUMENT

BACKGROUND OF THE INVENTION

1. Field of the Invention

The present invention relates to a pedal control apparatus of an electronic keyboard musical instrument, and more particularly to a pedal control apparatus of an electronic keyboard musical instrument, the pedal control apparatus controlling an external force exerted on a pedal in response to a depression manipulation of the pedal of the electronic keyboard musical instrument.

2. Description of the Related Art

It is known that an acoustic piano is designed such that a hammer strikes strings in response to a depression of a key to generate a tone. Tones generated by an acoustic piano vary in resonance and magnitude according to the intensity and speed of the depression of keys. Furthermore, an acoustic piano is equipped with pedals for controlling reverberation of tones. In a case of a grand piano, for example, the pedals include a damper pedal, a sostenuto pedal and a shift pedal. In synchronization with a depression manipulation (=performance manipulation) of the pedals by a player, these pedals pivot about fulcrums provided on the main body of a keyboard musical instrument.

Of these pedals, the damper pedal (hereinafter simply referred to as the pedal), which is a pedal for controlling dampers provided in order to stop vibration of strings of a piano, is most frequently used. The dampers are associated with strings in a one-to-one correspondence. Commonly, the damper is released in response to a depression of a key, while the damper presses down strings to stop resonance of a tone in response to a release of the key. The respective dampers are connected to the pedal through some connecting portions. The connecting portions have small spaces between parts thereof, in other words parts of connecting portions are not close contact with each other. Even if the pedal is slightly depressed, as a result, the depression manipulation of the pedal will not be delivered to the dampers. If the pedal is deeply depressed, however, the dampers are removed from all the strings, so that tones will not be stopped by the dampers even if a player releases his fingers from keys. Therefore, all the tones for which the player has depressed the keys are sustained. In this case, all the strings including the strings provided for keys which are not depressed resonate, so that overtones are clearly resonated. As described above, by manipulating the dampers with the damper pedal, the player can enrich expressions of tones.

Therefore, displacement (pivoting) of the pedal from its initial position causes a reaction force (a force exerted in a direction in which the pedal returns, a load applied to a foot of the player) as shown in FIG. 5A being produced on the pedal. More specifically, while the pedal is slightly depressed so that the depression is not delivered to the dampers, the reaction force grows slowly with increasing amount of displacement of the pedal from the initial position. If the pedal is further depressed, so that the dampers start removing from the strings, the reaction force produced on the pedal grows sharply with increasing amount of displacement of the pedal. If the pedal is further depressed, so that the dampers are fully removed from the strings, the reaction force grows slowly again with increasing amount of displacement of the pedal. If the dampers then come into contact with a stopper, the reaction force increases sharply again. In other kinds of acoustic pianos, as shown in FIG. 5B, there is a case in which the increasing rate of the reaction force produced on the pedal according to increasing amount of displacement of the pedal from the initial position is nearly equal to the increasing rate of the reaction force produced on the pedal according to increasing amount of displacement of the pedal from the position at which the dampers start removing form the strings. As shown in FIGS. 5A and 5B, hysteresis occurs in characteristics of the reaction force produced on the pedal relative to the amount of displacement of the pedal, so that the path of the reaction force varies between release of the pedal and depression of the pedal.

As described above, a range $A_H$ within which the reaction force grows sharply with increasing amount of displacement of the pedal is the so-called "half pedal range". The half pedal range $A_H$ is a range within which the dampers slightly hold the strings. In the half pedal range $A_H$, the rate of change of the reaction force produced on the pedal is large, compared with an initial pedal depression range A1 (hereinafter referred to as initial range A1) within which the pedal is slightly depressed, so that the depression will not be delivered to the dampers and a latter pedal depression range A2 (hereinafter referred to as latter range A2) within which the dampers are fully removed from the strings to come into contact with the stopper. As described above, there is also a case in which the rate of change of the reaction force in the half pedal range $A_H$ is nearly equal to the rate of change of the reaction force in the initial range A1 (except a small range just after depression of the pedal and just before stopping of the pedal) and is larger than the rate of change of the reaction force in the latter range A2. Therefore, the half pedal range $A_H$ is a very important range in terms of musical change in any cases. More specifically, it is known that skilled players can perceive the above-described sharp grow of the reaction force to recognize the half pedal range $A_H$, so that they can control the amount of displacement of the pedal in stages within the half pedal range $A_H$ to vary the degree of the contact of the dampers with the strings to control timbre and resonance.

There exist electronic pianos which are electronic musical instrument which artificially reproduce timbre, operability and appearance of an acoustic piano. The electronic pianos are designed to make an electronic tone generating portion generate tones in accordance with player's manipulation of a keyboard. Therefore, the electronic pianos do not have any strings. Consequently, the electronic pianos are relatively less expensive than acoustic pianos, rapidly becoming widespread in recent years. As described above, because the electronic pianos do not have strings, the electronic pianos have a pedal structure which is different from that of acoustic pianos. Disclosed pedal structures of the conventional electronic pianos include a pedal unit for electronic keyboard instrument disclosed in Japanese Unexamined Patent Publication No. 2001-22355 and a pedal device of electronic keyboard instrument disclosed in Japanese Unexamined Patent Publication No. 2004-334008.

In the above-mentioned pedal unit for electronic keyboard instrument disclosed in Japanese Unexamined Patent Publication No. 2001-22355, a pedal is urged by a spring so that a reaction force (recovery force) acts when the pedal is depressed. The pedal device of electronic keyboard instrument disclosed in Japanese Unexamined Patent Publication No. 2004-334008 is provided with a first urging member, a second urging member, a lever and the like to realize a reaction force whose rate of change can vary in a single stage according to the amount of displacement of a pedal.

As for the pedal unit for electronic keyboard instrument disclosed in Japanese Unexamined Patent Publication No. 2001-22355, however, the rate of change of reaction force is constant with no variation. As for the pedal device of electronic keyboard instrument disclosed in Japanese Unexamined Patent Publication No. 2004-334008, although the rate of change of reaction force can vary stepwise, the variation is simple, so that the variations in reaction force of the disclosed pedal device are different from those of a pedal of an acoustic piano. Thus, an art disclosed in Japanese Examined Patent Publication No. H7-111631 can be applied to a pedal. More specifically, an external force can be applied to the pedal by an actuator so that the variations in reaction force similar to those of acoustic pianos can occur on the pedal.

Electronic musical instruments are provided with tones of different kinds of acoustic pianos (e.g., Yamaha (trademark) and Bosendorfer (trademark)) as tone generation data to reproduce timbres of the acoustic pianos. In conventional examples, however, even though a player is allowed to select his desired timbre from among different timbres, he cannot change characteristics of reaction force. Commonly, characteristics of reaction force of a pedal vary among manufacturers of pianos as in the case of timbres. The variations in characteristics of reaction force result from variations in structure of a pedal apparatus among the manufacturers (variations in components, load of dampers, coefficient of friction and viscous resistance caused by differences in materials and shape, etc.). In view of reproduction of pianos of various manufacturers, therefore, the conventional examples lack reality in that characteristics of reaction force of pedal cannot vary even though players can select their desired timbres.

Furthermore, variations in characteristics of reaction force of pedal among manufacturers also result in variations in the extent of the half pedal range $A_H$ and magnitude of load. In this case, the changing rate of the reaction in the half pedal range $A_H$ is different from the changing rate of the reaction in the initial range A1 or nearly equal to the changing rate of the reaction in the initial range A1 by the differences of the structures of the pedal. For a player accustomed to a piano of a certain manufacturer, as a result, characteristics of reaction force of pianos of different manufacturers make him feel strange when he manipulates a pedal in the half pedal range $A_H$. Therefore, the conventional examples are disadvantageous in that he will have difficulty in obtaining his desired timbre and resonance in the half pedal range $A_H$ or in that he has to get used to the instrument in order to control the pedal.

DISCLOSURE OF THE INVENTION

Problem to Be Solved by the Invention

With attention being directed to the above-described problem, the present invention was accomplished to provide a pedal control apparatus of an electronic keyboard musical instrument, the pedal control apparatus allowing a player to select his desired varying reaction forces exerted on a pedal from among varying reaction forces of different kinds of pianos to reproduce the selected varying reaction forces in order to eliminate player's uncomfortable feeling in his pedal manipulation to facilitate his pedal manipulation in the half pedal range.

Means for Solving the Problem

The pedal control apparatus of the electronic keyboard musical instrument according to the present invention accomplished in order to solve the above-described problem has a pedal which is placed on a main body of the electronic keyboard musical instrument so that the pedal pivots about a fulcrum in accordance with a player's performance manipulation; an action detecting means which detects an action of the pedal; an actuator which exerts an external force on the pedal; a control table storing means which stores control tables in which action of the pedal is associated with external force exerted on the pedal by the actuator; and a drive controlling means which obtains the external force associated with the action detected by the action detecting means from the control table to drive and control the actuator in accordance with the obtained external force. Furthermore, the present invention has following features. The control table storing means stores different kinds of control tables designed such that the external force associated with a certain action of the pedal varies among the control tables. The pedal control apparatus of the electronic keyboard musical instrument further comprises a table selecting means which selects any one of the different kinds of control tables in accordance with a player's manipulation of setting operators. The drive controlling means obtains the external force associated with an action detected by the action detecting means from the control table selected by the table selecting means.

In this case, the control tables include at least, for example, external force exerted on the pedal by the actuator, the external force being associated with action of the pedal in a half pedal range interposed between an initial pedal depression range and a latter pedal depression range of an entire stroke range, the half pedal range exhibiting significant rate of change of reaction force produced on the pedal relative to an amount of displacement of the pedal compared with the initial pedal depression range and the latter pedal depression range. Further, the half pedal range may exhibit significant rate of change of reaction force produced on the pedal relative to an amount of displacement of the pedal compared with at least the latter pedal depression range.

These features of the present invention enable reproduction of gradually varying reaction force produced on the pedal in response to player's manipulation of the pedal of acoustic pianos. By storing different control tables associated with acoustic pianos of different manufacturers, in addition, the present invention allows the player to select his desired varying reaction force produced on the pedal from among varying reaction forces of the acoustic pianos of the different manufacturers to reproduce the desired varying reaction force. As a result, the pedal apparatus of the electronic keyboard musical instrument according to the present invention eliminates player's uncomfortable feeling in his pedal manipulation to facilitate his pedal manipulation in the half pedal range.

Furthermore, the setting operators manipulated by a player in order to select any one of the different kinds of control tables selects a timbre of a musical tone signal emitted in accordance with manipulation of a keyboard of the main body of the electronic musical instrument, for example. Because of this feature, the player is required only to select his desired timbre by use of the setting operators to reproduce varying reaction force produced on the pedal suitable for the desired timbre.

Furthermore, the different kinds of control tables stored in the control table storing means are supplied from a storage medium which is different from the control table storing means provided for the main body of the electronic keyboard musical instrument or supplied through a communications network from an external storing means provided outside the main body of the electronic keyboard musical instrument. This feature enables the player to store his desired control tables in the control table storing means through the storage medium or the communications network.

Furthermore, the pedal control apparatus further comprises a spring which urges the pedal toward its initial position, so that an external force is exerted on the pedal not only by the actuator but also by the spring. This feature allows employment of an actuator which exerts only a small amount of external force as the actuator.

DESCRIPTION OF THE PREFERRED EMBODIMENT

First Embodiment

Figure 1:
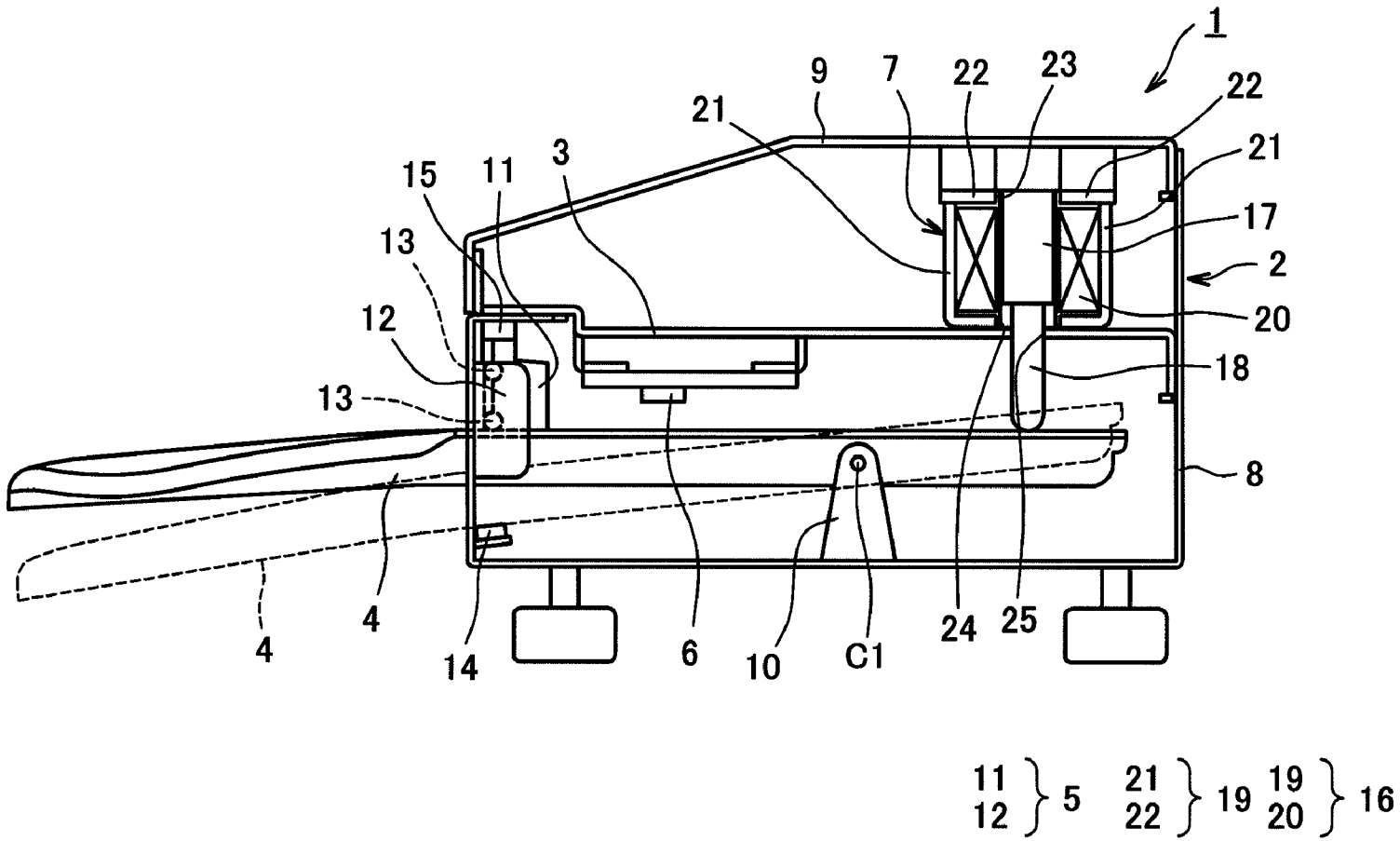
FIG. 1 is a cross sectional view showing a configuration of a pedal unit employed in an electronic keyboard apparatus equipped with a pedal control apparatus according to a first embodiment of the present invention.

An embodiment of the present invention will now be described with reference to the drawings. FIG. 1 is a cross sectional view showing a configuration of a pedal unit employed in an electronic keyboard apparatus equipped with a pedal control apparatus of the present invention. The pedal control apparatus controls a relationship between external force applied to a pedal when the pedal of an electronic keyboard musical instrument is depressed and perception held by a player because of the external force (hereafter, the relationship will be referred to as "force-perception").

Figure 2:
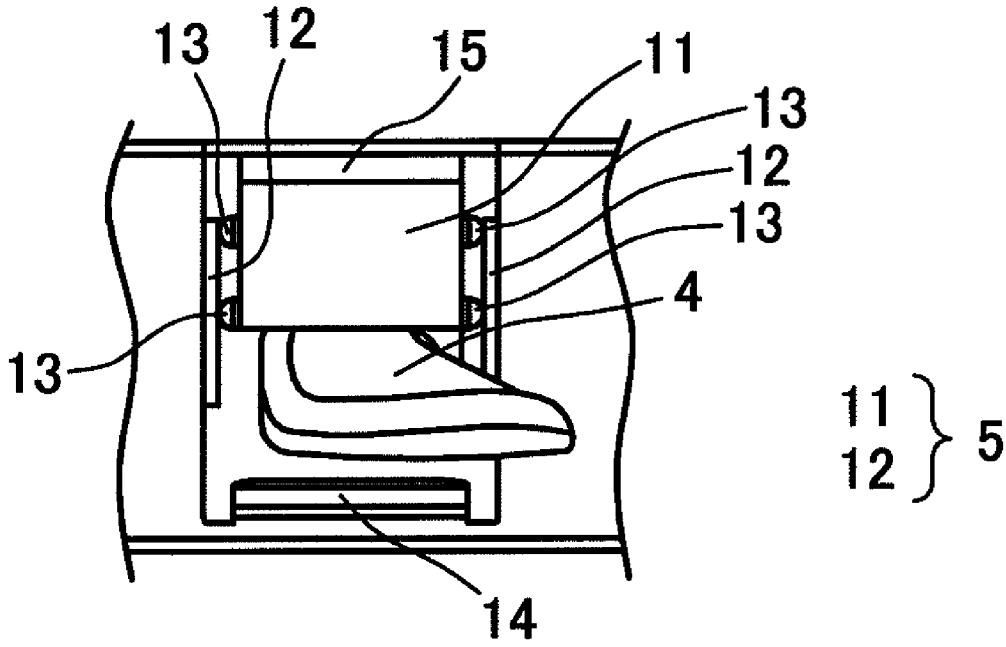
FIG. 2 is a front view of a part of the pedal unit shown in FIG. 1.

FIG. 2 is a front view of a part of the pedal unit shown in FIG. 1. A pedal unit 1 shown in FIG. 1 is placed below a main body of the keyboard musical instrument. In the following description, vertical, lateral, forward and backward directions of the pedal unit 1 indicate vertical, lateral, forward and backward directions seen by a player in an upright standing state during his performance. As shown in FIG. 1, the pedal unit 1 has a case 2, a board 3, a pedal 4, a guide portion 5, an action detecting portion 6 serving as an action detecting means and an actuator 7 serving as an actuating means.

The case 2 is formed of a case main body 8 which is open upward and a case lid 9 which caps the opening of the case main body 8 to house the board 3, the pedal 4, the guide portion 5, the action detecting portion 6 and the actuator 7. The board 3 is placed inside the case 2 in a horizontal position. The pedal 4 is placed to be long in the forward and backward directions. The pedal 4 is placed below the board 3 of the case 2. The pedal 4 is rotatably supported by a pedal supporting portion 10 provided on a bottom of the case main body 8, so that the pedal 4 can pivot about a fulcrum C1. The pedal 4 is placed so that the front end of the pedal 4 protrudes from an opening provided on the front of the case main body 8 to allow a player to depress the pedal 4.

The guide portion 5 is comprised of a guide main body 11 and a pair of restricting portions 12. The guide main body 11 is fixed to the top surface of the pedal 4. On the guide main body 11, domical protruding portions 13 which protrude toward the right and left are provided. The pair of restricting portions 12 are provided to interpose the right and left sides of the guide main body 11. As for the guide portion 5, if the pedal 4 has lateral deflection, the protruding portions 13 provided on the guide main body 11 come into contact with the pair of restricting portions 12 so as to restrict the lateral deflection of the pedal 4. A lower limit stopper member 14 comes into contact with the pedal 4 so as to restrict the lower limit of the pivoting of the pedal 4 when the pedal 4 is fully depressed as shown by dotted lines. An upper limit stopper member 15 comes into contact with the guide main body 11 so as to restrict the upper limit of the pivoting of pedal 4 when the pedal 4 is not depressed to remain in its initial position as shown by solid lines.

The action detecting portion 6 detects actions of the pedal 4 (any one or more of position (amount of displacement), velocity, acceleration, pivoting angle and angular velocity of the pedal). As the action detecting portion 6, a position detecting sensor such as a rotational resistor and an optical sensor can be employed. In this embodiment, the action detecting portion 6 is provided on the undersurface of the board 3 so as to oppose to the pedal 4. However, the present invention is not limited to this configuration.

The actuator 7 has a magnetic circuit 16, a plunger 17 and a shaft 18. The magnetic circuit 16 is comprised of a magnetic frame 19, a coil 20 and the like. The magnetic frame 19 is made of a soft magnetic substrate to house the coil 20. The magnetic frame 19 is formed of a frame main body 21 shaped like a saucer which is open upward, and a frame lid 22 which caps the opening of the frame main body 21. On the frame lid 22 and the flame main body 21, an upper opening portion 23 from which the later-described plunger 17 protrudes and a lower opening portion 24 from which the later-described shaft 18 protrudes are arranged in a vertical direction. The coil 20, which is made of copper wire and the like, is wound around an insulating bobbin which is not shown.

The plunger 17 is placed in the center of the later-described coil 20 so that an axe thereof is parallel in a vertical direction. The plunger 17 is urged by a spring which is not shown so that the top end of the plunger 17 protrudes from the coil 20 when the pedal 4 is not depressed to stay in the initial position. The shaft 18 is fixed to the bottom of the plunger 17. The lower end of the shaft 18 protrudes from the lower opening portion 24 provided on the frame main body 21 and a board opening portion 25 provided on the board 3 to be contact with a part of the pedal 4, the part being located behind the pedal supporting portion 10. If the coil 20 is energized, the actuator 7 applies a force which pulls the plunger 17 into the coil 20 (downward force). As a result, the plunger 17 applies a downward external force to a part situated behind the supporting portion 10 of the pedal 4 through the shaft 18 to exert a reaction force on a player. As a current passing through the coil 20 increases, the force pulling the plunger 17 into the coil 20 also increases, resulting in increase in the reaction force exerted on the player.

Figure 3:
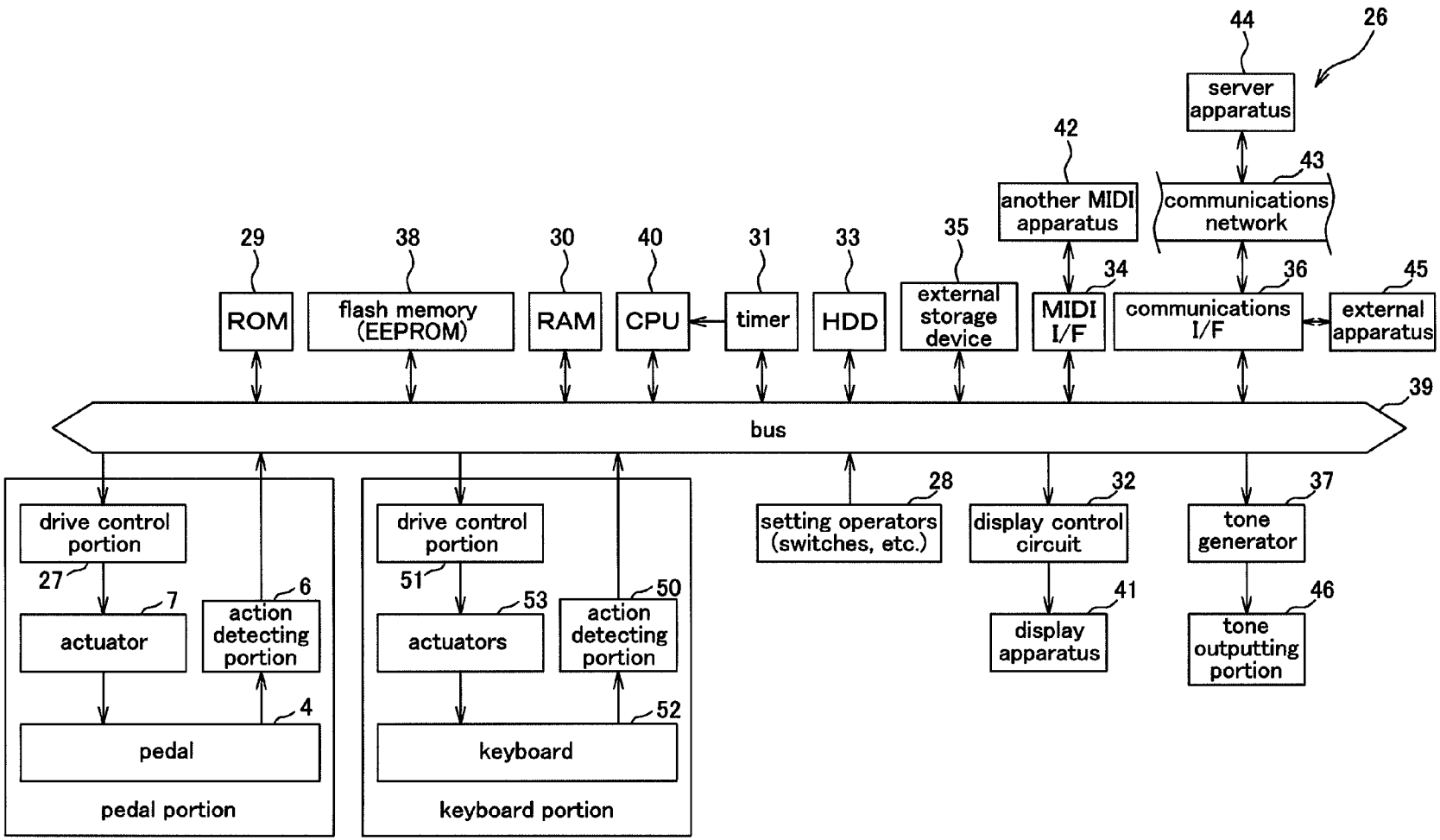
FIG. 3 is a block diagram showing a configuration of the keyboard apparatus equipped with the pedal unit shown in FIG. 1.

Next, an electrical configuration of an electronic keyboard musical instrument 26 equipped with the pedal unit 1 configured as described above will be explained with reference to FIG. 3. As shown in the figure, the electronic keyboard musical instrument 26 is provided with the above-described action detecting portion 6, a drive control portion 27, an action detecting portion 50, a drive control portion 51, setting operators 28, a ROM 29, a RAM 30, a timer 31, a display control circuit 32, a hard disk drive (HDD) 33, a MIDI (Musical Instrument Digital Interface) interface (MIDI I/F) 34, an external storage device 35 used as an external storage means, a communications interface (communications I/F) 36 used as an external connecting means, a tone generator 37, and a flash memory 38 so that each of these components is connected to a CPU 40 through a bus 39.

The CPU 40 operates in accordance with various control programs to control the entire electronic keyboard musical instrument 26. The action detecting portion 6 detects actions of the pedal 4 as described above and transmits detected action information to the bus 39. To the drive control portion 27, the actuator 7 is electrically connected so that reception of a command value from the bus 39 causes the drive control portion 27 to supply a current corresponding to the command value through the coil 20 of the actuator 7 to bring the actuator 7 into action. The action detecting portion 50 detects actions of a keyboard 52 and transmits detected action information to the bus 39. To the drive control portion 51, actuators 53 which exert external forces on the keyboard 52 are connected so that reception of command values from the bus 39 causes the drive control portion 51 to supply currents corresponding to the command values through unshown coils of the actuators 53 to bring the actuators 53 into action to exert reaction forces on the keyboard 52. The ROM 29 stores later-described various control process programs executed by the CPU 40 and song data in SMF (Standard Midi File) format and the like. The RAM 30 temporarily stores input information such as automatic performance data and text data, various kinds of flags, buffer data, performance results and the like. The timer 31 measures interrupt time in timer interrupt process and various kinds of time.

To the display control circuit 32, a display apparatus 41 formed of an LCD, for example, and the like is connected. The display control circuit 32 makes the display apparatus 41 display various kinds of information such as a score and a force-perception selection screen. The HDD 33 stores various kinds of application programs including the later-described various control programs executed by the CPU 40, control tables used for a later-described force-perception control process, and the like. In a case where the control process programs are not stored in the ROM 29, a hard disk of the HDD 33 can store the control process programs so that the RAM 30 reads the control process programs to allow the CPU 40 to operate in a manner similar to the case where the ROM 29 stores the control process programs. Such a configuration allows addition and update of the control process programs.

To the MIDI I/F 34, other MIDI apparatus 42 is connected. The MIDI I/F 34 inputs MIDI signals from an external apparatus such as the other MIDI apparatus 42 and outputs MIDI signals to the external apparatus. The external storage device 35 is connected to an external storage medium to drive the storage medium. To the communications I/F 36, a server apparatus 44 is connected through a communications network 43 such as a LAN (local area network), the Internet or a telephone line. To the communications I/F 36, in addition, an external apparatus 45 such as a personal computer is connected.

The communications I/F 36 is used in order to download control process programs executed by the CPU 40 and the later-described control tables from the server apparatus 44. The CPU 40 transmits a command requesting downloading of the control process programs and the control tables to the server apparatus 44 through the communications I/F 36 and the communications network 43. In response to the command, the server apparatus 44 transmits the requested control process programs and the later-described control tables to the bus 39 through the communications network 43 and the communications I/F 36. On receiving these control process programs and the control tables, the CPU 40 stores these programs and the tables in the hard disk of the HDD 33 to complete the downloading. The communications I/F 36 is connected to the external apparatus 45 to allow the electronic keyboard musical instrument 26 to receive the control process programs and the control tables from the external apparatus 45 as well.

To the tone generator 37, a tone outputting portion 46 is connected. The tone generator 37 converts performance data output by the CPU 40 in accordance with manipulation of the keyboard to musical tone signals to output the converted signals to the tone outputting portion 46. The tone outputting portion 46, which is formed of a DAC (Digital-to-Analog Converter), amplifiers, speakers and the like, outputs tones corresponding to the musical tone signals output by the tone generator 37. Obviously, as described above, the tone generator 37 and the tone outputting portion 46 correspond to an electronic tone generating portion. The flash memory 38 is formed of EEPROM (Electrically Erasable Programmable ROM), for example, and the like. The flash memory 38 can perform repeated storing of song data and storing of the later-described control tables.

Figure 4:
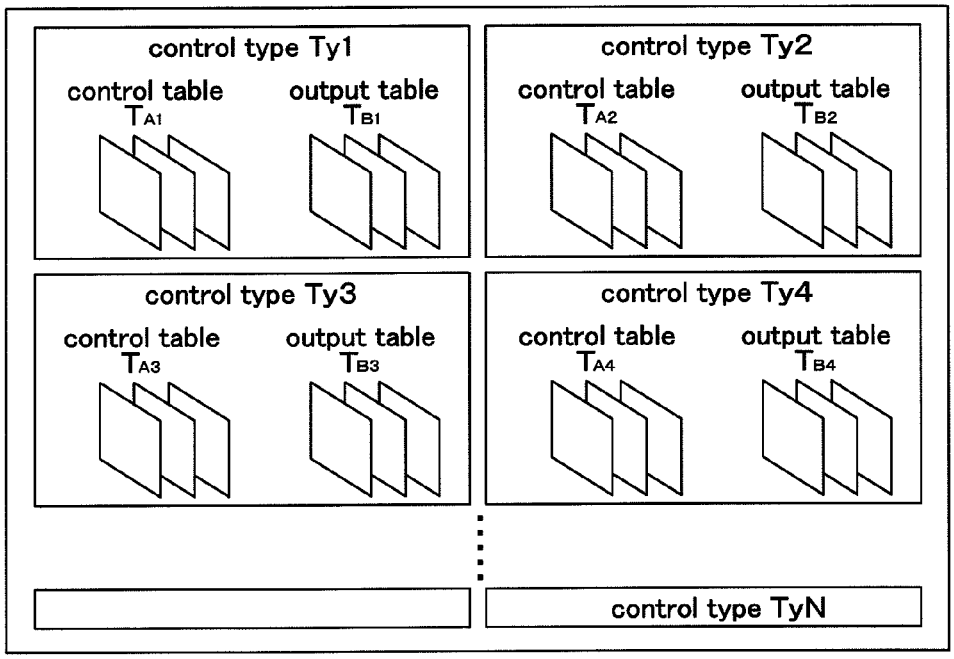
FIG. 4 is an explanatory drawing illustrating control tables and output tables of types 1 through N stored in a flash memory or an HDD.

Next, control tables $T_{A1}$ to $T_{AN}$ and output tables $T_{B1}$ to $T_{BN}$ used for the force-perception control will be described with reference to FIGS. 4, 5A, 5B, 6A and 6B. As shown in FIG. 4, in the memory of the electronic keyboard musical instrument 26 such as the flash memory 38 and the HDD 33, different kinds of control tables $T_{A1}$ to $T_{AN}$ and output tables $T_{B1}$ to $T_{BN}$ of control type Ty1 to control type TyN are stored to correspond to each other. The control type Ty1 to control type TyN indicate respective types of acoustic pianos of various manufacturers, for example. In the memory of the electronic keyboard musical instrument 26, more specifically, various kinds of control tables $T_{A1}$ to $T_{AN}$ and output tables $T_{B1}$ to $T_{BN}$ corresponding to acoustic pianos of various manufacturers are stored.

Figure 5A:
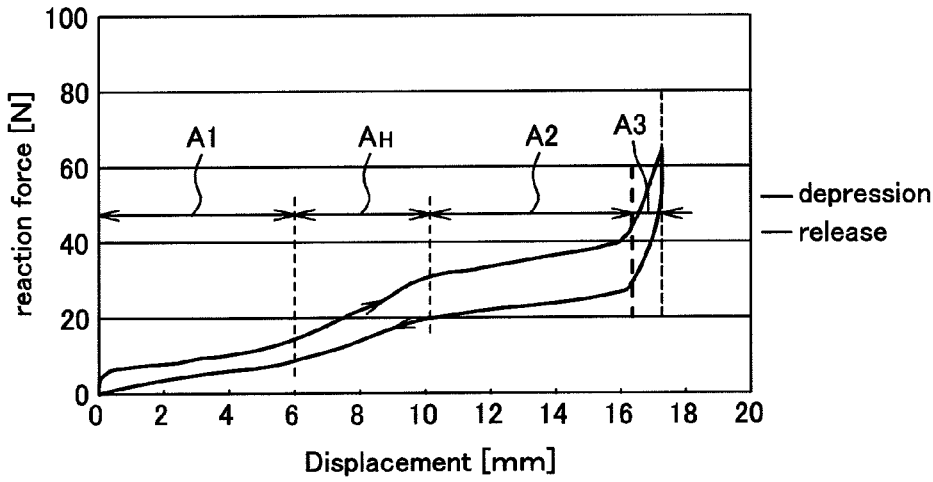
FIG. 5A is a graph showing reaction force produced on a pedal relative to the amount of displacement of the pedal on certain operational conditions.
Figure 5B:
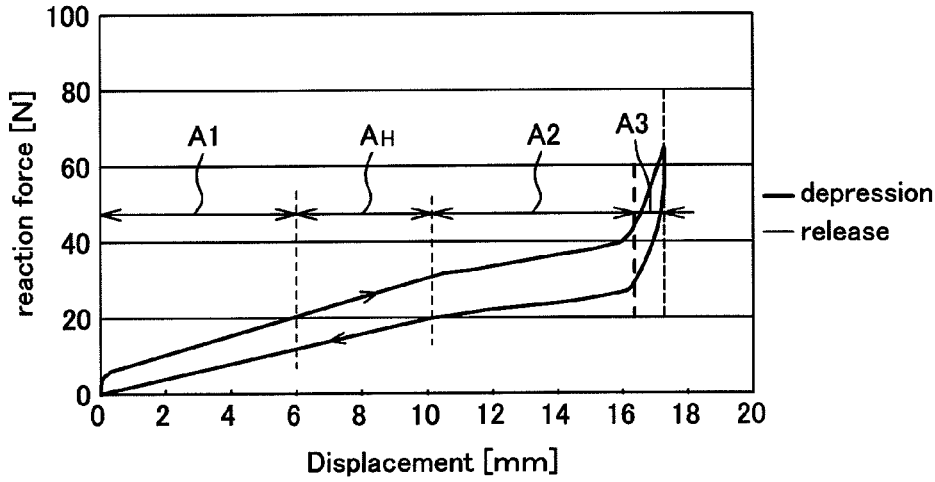
FIG. 5B is graph showing another reaction force produced on a pedal relative to the amount of displacement of the pedal on certain operational conditions.

The control tables $T_{A1}$ to $T_{AN}$ are tables in which actions (amount of displacement, velocity) of the pedal 4 are associated with reaction force exerted by the actuator 7 on the pedal 4 in order to reproduce the initial range A1, the half pedal range $A_H$ and the latter range A2 as shown in FIGS. 5A and 5B. Detailed descriptions about the initial range A1, half pedal range $A_H$ and latter range A2 will be omitted, for these descriptions have been already given in Description of the Related Art. The respective control tables $T_{A1}$ to $T_{AN}$ are formed of a plurality of table portions in which the amount of displacement of the pedal 4 is associated with the reaction force exerted by the actuator 7 on the pedal 4 according to the velocity of the pedal 4, for example. Because within the range A3 corresponding to the amount of displacement which results in from contact of the pedal 4 with the lower limit stopper member 14 to the largest amount of displacement, the reaction force is produced by the contact with the lower limit stopper member 14, the respective control tables $T_{A1}$ to $T_{AN}$ may be programmed such that the rate of change of reaction force is zero or minus. In the respective control tables $T_{A1}$ to $T_{AN}$, furthermore, the action (amount of displacement, velocity) of the pedal 4 is associated with the reaction force exerted by the actuator 7 on the pedal 4 to exhibit hysteresis in which a certain amount of displacement results in different reaction forces between the depression of the pedal 4 and the release of the pedal 4 as shown in FIGS. 5A and 5B.

Figure 6A:
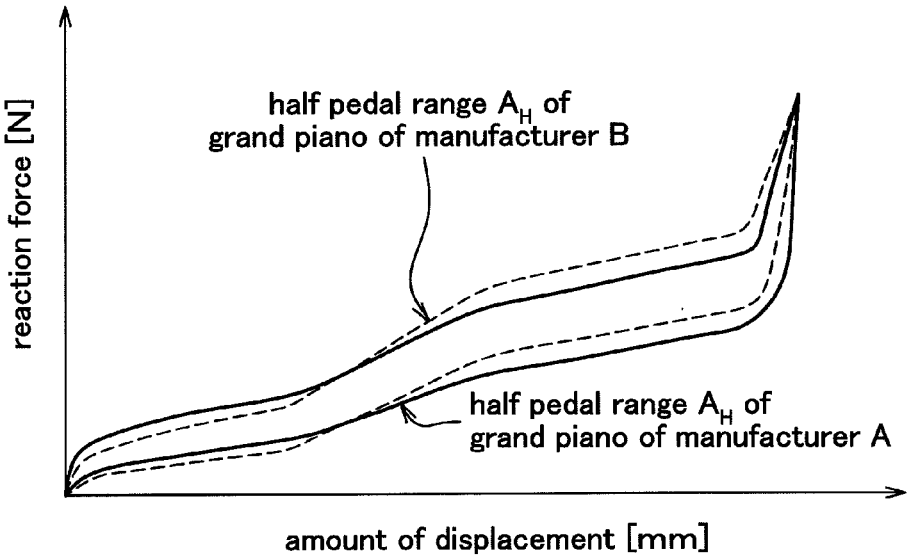
FIG. 6A is a graph showing reaction force produced on the pedal relative to the amount of displacement of the pedals of manufacturers A and B.
Figure 6B:
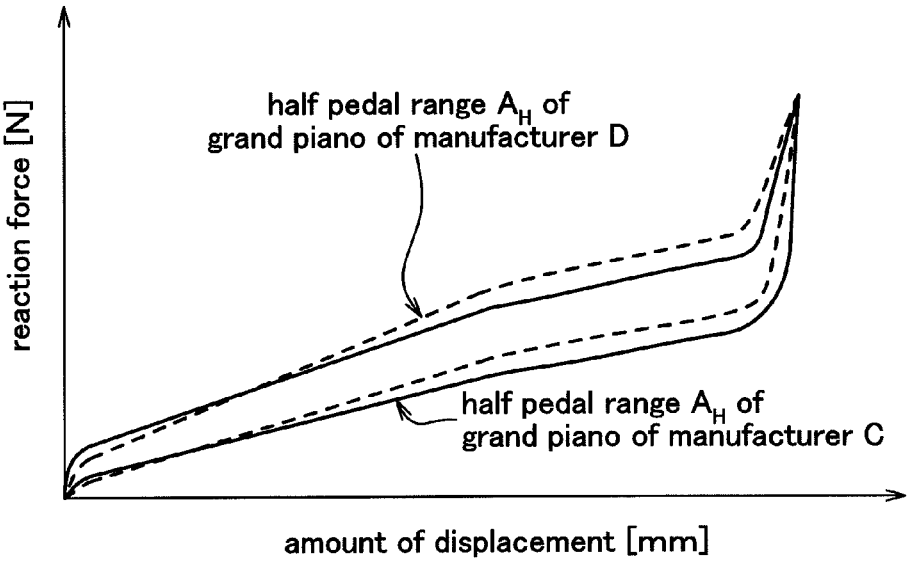
FIG. 6B is a graph showing another reaction force produced on the pedal relative to the amount of displacement of the pedals of manufacturers C and D.

FIGS. 6A and 6B are graphs showing characteristics of reaction force exerted on the pedal 4 relative to an amount of displacement of the pedal 4 (damper) of different manufacturers A, B, C and D which manufacture grand pianos. As apparent from comparison between the respective characteristics of reaction force, the magnitude of reaction force relative to a certain amount of displacement, start and finish positions of the half pedal range $A_H$, the magnitude of reaction force exerted in the half pedal range $A_H$, and the rate of change of reaction force vary between the manufacturers. The respective control tables $T_{A1}$ to $T_{AN}$ are programmed, as in the case of this example, such that a reaction force relative to a certain action (amount of displacement, velocity) detected by the action detecting portion 6 varies between the manufacturers in order to reproduce the characteristics of reaction force exerted on the pedal 4 (damper) that are different between the manufacturers. The output tables $T_{B1}$ to $T_{BN}$ show command values to be output to the actuator 7, the command values corresponding to the reaction forces to be exerted on the pedal 4.

The control tables $T_{A1}$ to $T_{AN}$ and the output tables $T_{B1}$ to $T_{BN}$ may be previously stored in the memory (e.g., the ROM 29) of the electronic keyboard musical instrument 26. By the CPU 40 serving as a storing means, furthermore, the control tables $T_{A1}$ to $T_{AN}$ and the output tables $T_{B1}$ to $T_{BN}$ stored in the storage medium connected to the external storage device 35 may be stored in the memory (e.g., the HDD 33, the flash memory 38) of the electronic keyboard musical instrument 26. By the CPU 40, in addition, the control tables $T_{A1}$ to $T_{AN}$ and the output tables $T_{B1}$ to $T_{BN}$ transmitted from the server apparatus 44 through the communications network 43 may be stored in the memory (e.g., the HDD 33, the flash memory 38) of the electronic keyboard musical instrument 26. Obviously, as described above, the memory of the electronic keyboard musical instrument 26 which stores the control tables $T_{A1}$ to $T_{AN}$ and the output tables $T_{B1}$ to $T_{BN}$ corresponds to a control table storing means of the present invention.

Figure 7:
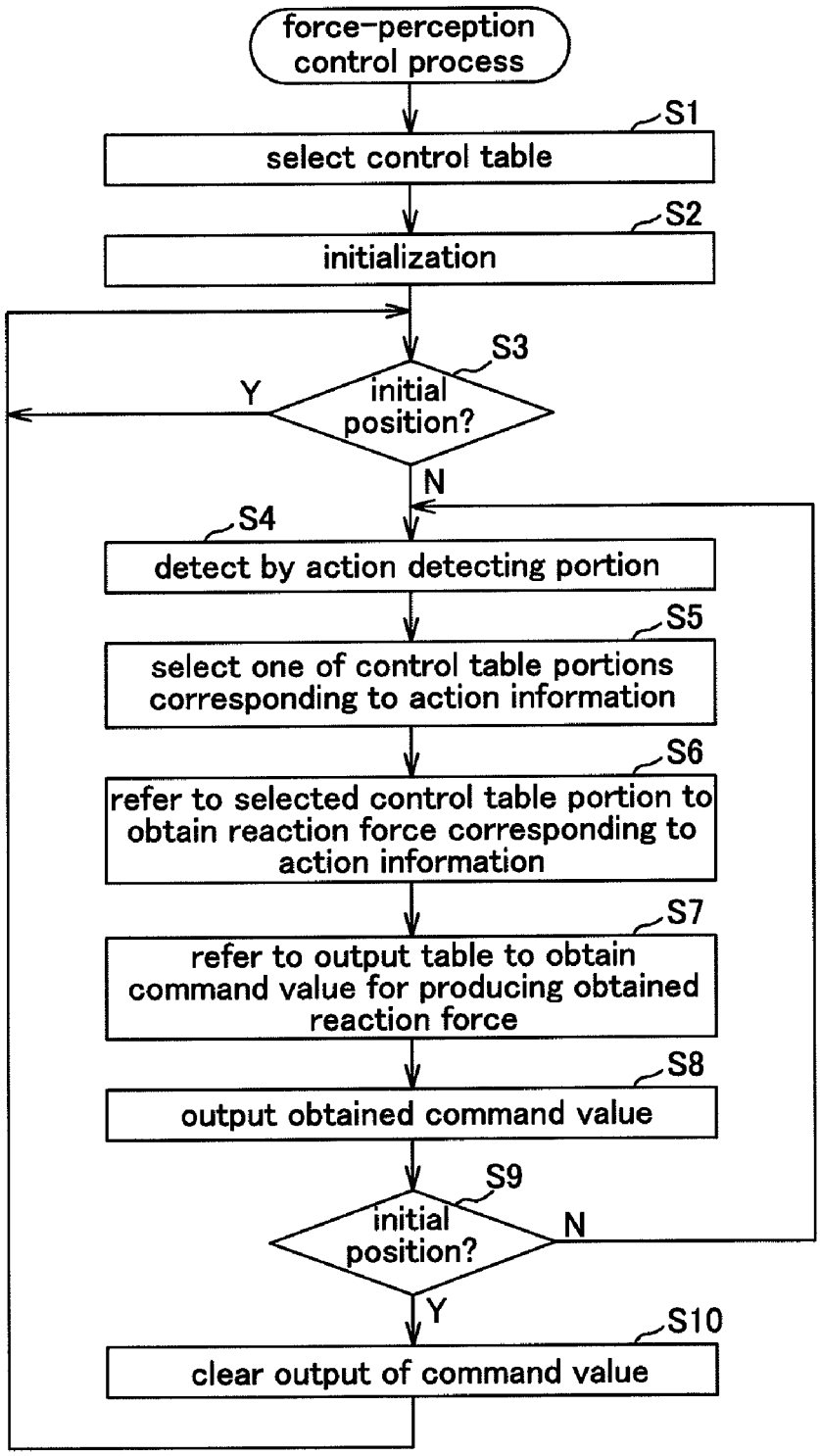
FIG. 7 is a flowchart showing a force-perception control process program executed by a CPU shown in FIG. 3.

Next, operations of the electronic keyboard musical instrument 26 configured as described above will be explained with reference to a flowchart shown in FIG. 7. In response to turning on of the power, the CPU 40 starts a force-perception control process program. In the force-perception control process, the CPU 40 serves as a control table selecting means to select any one of the control types Ty1 to TyN (step S1). In step S1, the CPU 40 controls the display control circuit 32, for example, to display a force-perception selecting screen for the pedal 4 on the display apparatus 41. The force-perception selecting screen for the pedal 4 is a screen which prompts a player to select any one of the control types Ty1 to TyN corresponding to the types of acoustic pianos such as Yamaha (trademark) and Bosendorfer (trademark). The player manipulates the setting operators 28 to select any one of the control types Ty1 to TyN while looking at the force-perception selecting screen. In accordance with the manipulation of the setting operators 28 by the player, the CPU 40 selects one of the various control types Ty1 to TyN and then reads one of the control tables $T_{A1}$ to $T_{AN}$ and one of the output tables $T_{B1}$ to $T_{BN}$ into the RAM 30, the each one of the tables corresponding to the selected one of the control types Ty1 to TyN.

The CPU 40 then executes various kinds of initialization processes (step S2), and then controls the action detecting portion 6 to detect an action of the pedal 4 to retrieve information on the detected action (any one or more of displacement, velocity, acceleration, angle and angular velocity, and depressed direction (depression or release)) to determine on the basis of the retrieved action information whether the pedal 4 is placed in the initial position or not (step S3). If the pedal 4 is not placed in the initial position, the CPU 40 proceeds to the next step S4. In step S4, the CPU 40 controls the action detecting portion 6 again to detect an action of the pedal 4 to retrieve the detected information on the action. The CPU 40 then selects a control table portion corresponding to the action information retrieved in step S4 from among a plurality of control table portions which form the control table $T_{A1}$ to $T_{AN}$ of the control type Ty1 to TyN selected in step S1 (step S5).

The CPU 40 then refers to the control table portion selected in step S5 to obtain a reaction force corresponding to the action information (in this embodiment, amount of displacement and direction of depressing manipulation) retrieved in step S4, the reaction force being to be exerted on the pedal 4 by the actuator 7 (step S6).

The CPU 40 then refers to the output table $T_{B1}$ to $T_{BN}$ to obtain a command value corresponding to the reaction force to be exerted on the pedal 4 obtained in step S6, the command value being directed to the actuator 7 (step S7). The CPU 40 then outputs the command value obtained in step S7 to the drive control portion 27 (step S8). The above-described steps S4 through S8 are reiterated until the pedal 4 returns to the initial position. Consequently, a manipulation of the pedal by the player results in a reaction force according to the selected control type $T_y$1 to $T_y$N being given to the player.

Although the reaction force exerted on the pedal 4 by the actuator 7 is constant in the range A3, the reaction force as shown by solid line of FIG. 5A is given to the player by the action of a reaction force applied by the lower limit stopper member 14. Afterward, if the pedal 4 returns to its initial position, the CPU 40 clears the output of the command value directed to the drive control portion 27 (step S10), and then returns to step S3 again. Obviously from these operations, the CPU 40 serves as a drive control means (force-perception control means) in steps S4 through S8.

Concurrently with the above-described force-perception control process, the CPU 40 also executes a tone generator control process which controls the tone generator 37 to allow the tone outputting portion 46 to output a tone according to a manipulation of the keyboard 52 detected by the action detecting portion 50. In this tone generator control process, the CPU 40 controls the tone generator 37 such that if the pedal 4 is placed in the half pedal range $A_H$, the timbre and resonance vary gradually from the start position to the finish position of the half pedal range $A_H$.

Because the above-described electronic keyboard musical instrument 26 is designed such that the CPU 40 selects one of the control types Ty1 to TyN in accordance with a player's manipulation of the setting operators 28 to obtain the reaction force corresponding to action information detected by the action detecting portion 6 on the basis of the control table $T_{A1}$ to $T_{AN}$ and the output table $T_{B1}$ to $T_{BN}$ of the selected control type Ty1 to TyN, the electronic keyboard musical instrument 26 can reproduce gradually varying reaction forces exerted on the pedal 4 of an acoustic piano in response to manipulation of the pedal 4 of the acoustic piano. In addition, the electronic keyboard musical instrument 26 stores the plurality of control types Ty1 to TyN corresponding to acoustic pianos of various manufacturers, so that the player of the electronic keyboard musical instrument 26 can select his desired varying reaction force exerted on the pedal 4 from among the acoustic pianos of the various manufacturers to reproduce the desired varying reaction force. As a result, the electronic keyboard musical instrument 26 can prevent the player from feeling uncomfortable in his pedal manipulation, also facilitating his pedal manipulation in the half pedal range $A_H$.

According to the above-described electronic keyboard musical instrument 26, furthermore, the CPU 40 can cause the memory of the electronic keyboard musical instrument 26 to store the control types stored in a storage medium connected with the external storage device 35. In addition, the CPU 40 can cause the memory of the electronic keyboard musical instrument 26 to store the control types transmitted from the server apparatus 44 through the communications network 43. Therefore, the player can make the memory of the electronic keyboard musical instrument 26 store his desired control types through a storage medium or the communications network.

In the above-described first embodiment, the player is allowed to select his desired control type of the pedal 4 by use of the setting operators 28. However, the present invention is not limited to this scheme. For example, the electronic keyboard musical instrument 26 can be programmed such that the CPU 40 serving as a tone generator control means controls the tone generator 37 to emit tones having a timbre selected from among a plurality of timbres by the player's manipulation of the setting operators 28. In this case, the CPU 40 controls the display control circuit 32, for example, to display a timbre selection screen on the display apparatus 41. The timbre selection screen prompts the player to select his desired timbre of an acoustic piano from among acoustic pianos of various manufacturers such as Yamaha (trademark) and Bosendorfer (trademark). The player manipulates the setting operators 28 to select his desired timbre, while looking at the timbre selection screen. In this case, the CPU 40 then selects one which corresponds to the player's manipulation of the setting operators 28 for selecting a timbre from among the control types Ty1 to TyN to read the selected control type Ty1 to TyN into the RAM 30.

This modification is designed such that the CPU 40 selects one of the plurality of control types Ty1 to TyN, the one corresponding to a timbre selected by use of the setting operators 28. Therefore, this modification requires the player only to manipulate the setting operators 28 to select his desired timbre to reproduce varying reaction force exerted on the pedal 4, the varying reaction force being suitable for the player's selected timbre.

Second Embodiment

Figure 8:
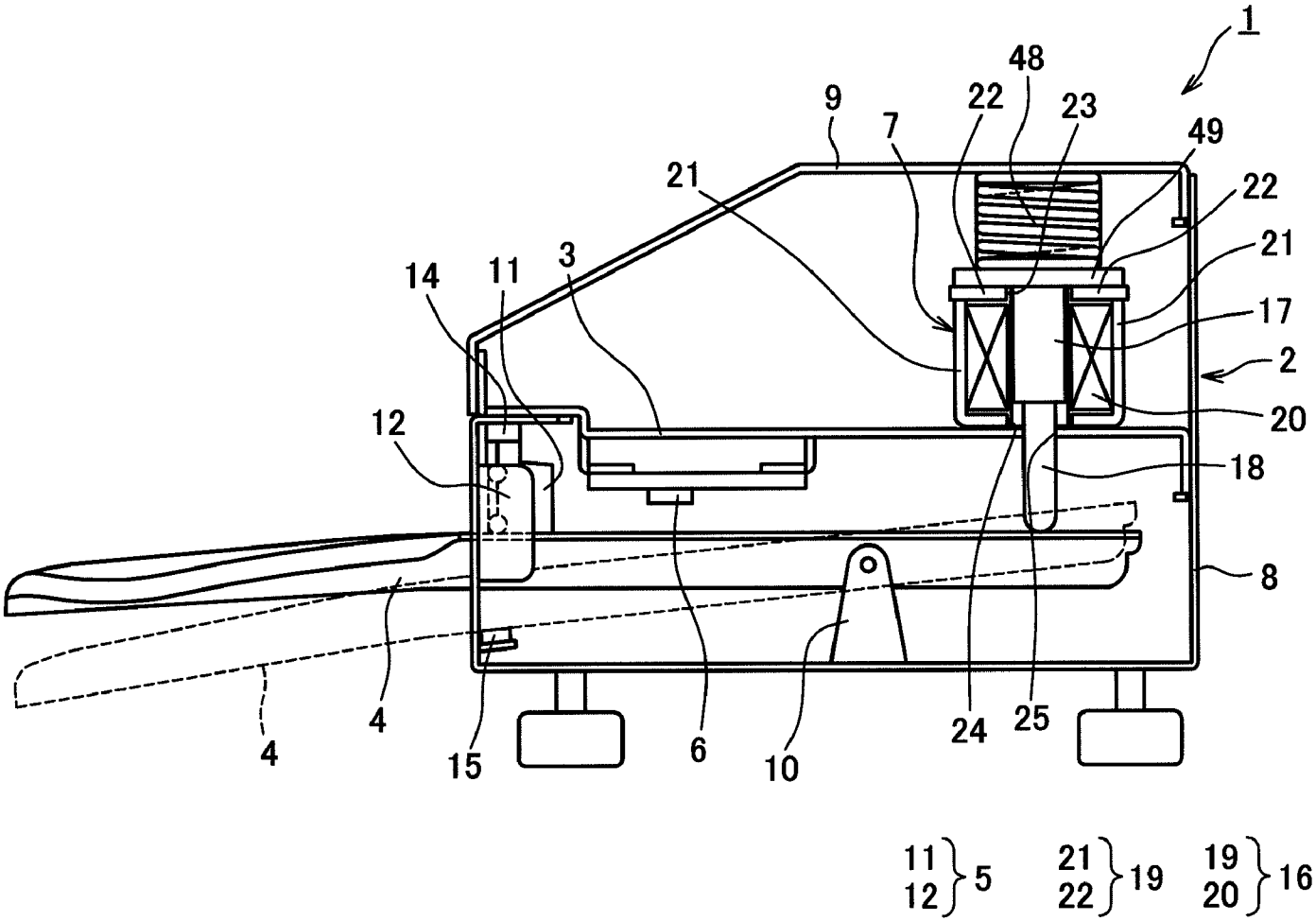
FIG. 8 is a cross sectional view showing a configuration of a pedal unit employed in an electronic keyboard apparatus equipped with a pedal control apparatus according to a second embodiment of the present invention.

Next, the pedal unit 1 of the electronic keyboard musical instrument 26 according to the second embodiment will be described with reference to FIG. 8. Significant differences in the second embodiment from the first embodiment are the configuration of the actuator 7 and an addition of a spring 48. As shown in FIG. 8, the actuator 7 has a flange portion 49 in addition to the magnetic circuit 16, the plunger 17 and the shaft 18. The flange portion 49 is provided on the top end of the plunger 17. The flange portion 49 is designed to be larger than the upper opening portion 23 provided on the frame lid 22. The plunger 17 is designed such that if the pedal 4 is not depressed to remain in the initial position, the flange portion 49 is contact with the frame lid 22.

Figure 9:
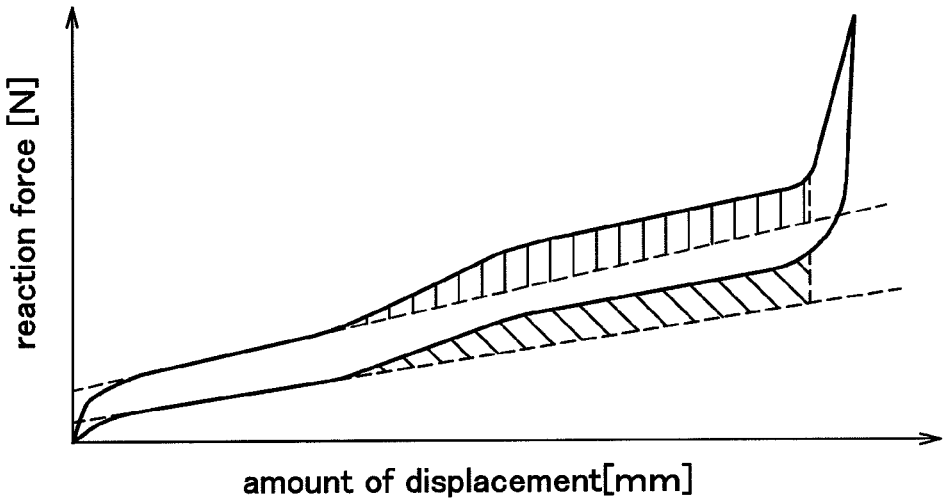
FIG. 9 is a graph showing reaction force exerted on the pedal by a spring and an actuator relative to the amount of displacement of the pedal on certain operational conditions.
Figure 10A:
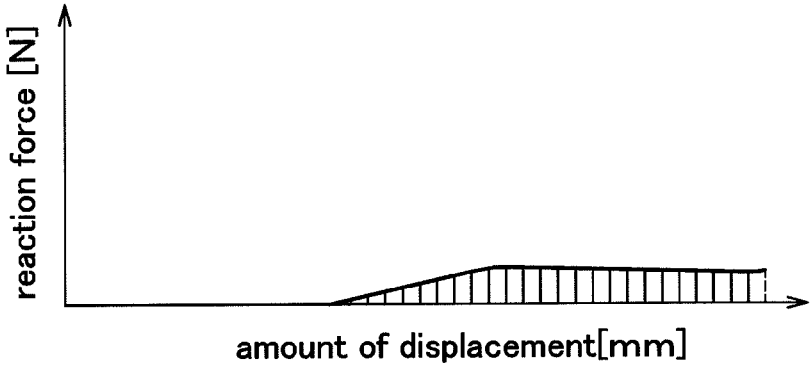
FIG. 10A is a graph showing reaction force exerted on the pedal by the actuator relative to the amount of displacement of the depressed pedal on certain operational conditions.
Figure 10B:
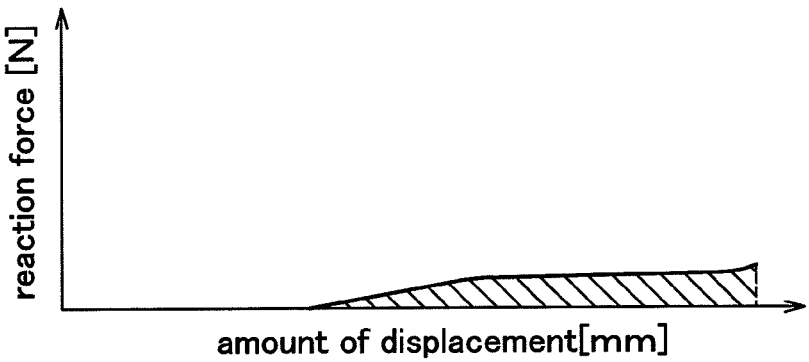
FIG. 10B is a graph showing reaction force exerted on the pedal by the actuator relative to the amount of displacement of the released pedal on certain operational conditions.

One end of the spring 48 is fixed to the case lid 9, with the other end being fixed to the flange portion 49. The spring 48 urges the plunger 17 downward. Because of the spring 48, on the pedal 4, the reaction force which linearly grows according to the amount of displacement of the pedal 4 from the initial position as shown by dotted lines in FIG. 9 is exerted. Therefore, vertically and diagonally shaded areas shown in FIG. 9 which cannot be reproduced by the spring 48 are made up by the actuator 7. In a case where the spring 48 is employed, consequently, the control tables $T_{A1}$ to $T_{AN}$ are programmed to exhibit the relationship of the magnitude of the reaction force exerted on the pedal 4 by the actuator 7 relative to the amount of displacement of the pedal 4 as shown in FIGS. 10A and 10B. As a result, the electronic keyboard musical instrument 26 can produce the reaction force according to the amount of displacement of the pedal 4 as shown in FIG. 9. As described above, by employing the spring 48 serving as a reaction force producing member which increases the reaction force exerted on the pedal 4 with increasing amount of displacement of the pedal 4 from the initial position, the reaction force exerted on the pedal 4 by the actuator 7 can be reduced, resulting in reduction in power consumption of the actuator 7 and the keyboard musical instrument itself, and downsizing and weight reduction of the keyboard musical instrument.

In the first embodiment, more specifically, if the actuator 7 is controlled in accordance with the control tables, the reaction force exerted on the pedal 4 by the actuator 7 relative to the amount of displacement of the pedal 4 is equal to the reaction force exerted on the pedal 4 shown in FIGS. 5A and 6A. In the second embodiment, however, because of the existence of the spring 48 which produces a reaction force in accordance with the amount of displacement of the pedal 4, if the actuator 7 is controlled in accordance with the control tables, the reaction force exerted on the pedal 4 by the actuator 7 relative to the amount of displacement of the pedal 4 is equal to a value obtained by subtracting the reaction force exerted on the pedal 4 by the spring 48 shown by dotted lines in FIG. 9 from the reaction force produced on the pedal 4 shown by solid lines. Additionally, the reaction force exerted on the pedal 4 by the actuator 7 is equal to a value obtained by subtracting the reaction force exerted on the pedal 4 by the spring 48 from the reaction force produced on the pedal 4 as described above in the case in which the reaction force exerted on the pedal 4 by the actuator 7 also varies as shown in FIGS. 5B and 6B.

Third Embodiment

Figure 11:
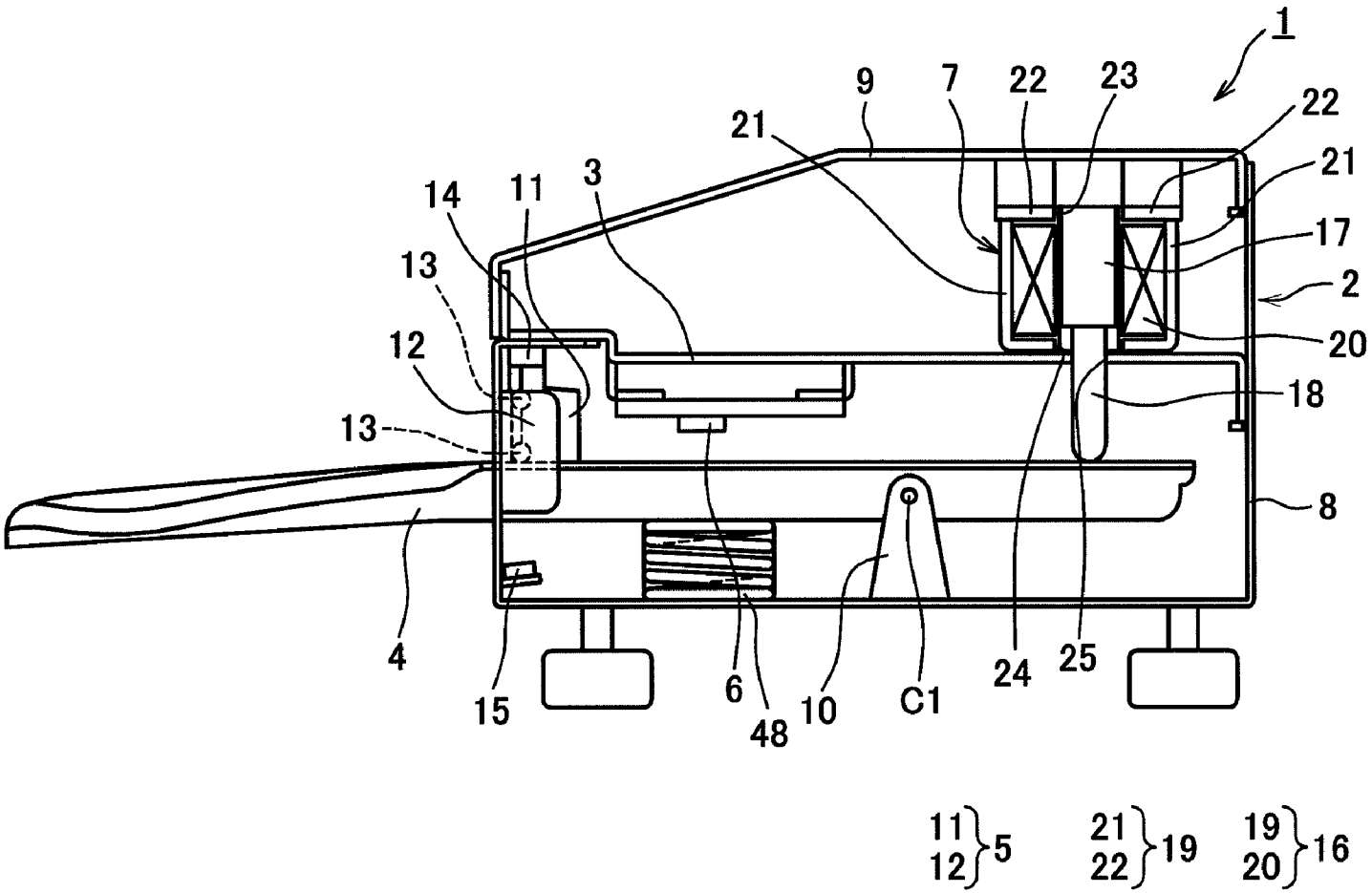
FIG. 11 is a cross sectional view showing a configuration of a pedal unit employed in an electronic keyboard apparatus equipped with a pedal control apparatus according to a third embodiment of the present invention.

Next, the pedal unit 1 of the electronic keyboard musical instrument 26 according to the third embodiment will be described with reference to FIG. 11. A significant difference in the third embodiment from the second embodiment is the position where the spring 48 is placed. As shown in the figure, the third embodiment employs the same actuator 7 as that of the first embodiment. One end of the spring 48 is fixed to the bottom of the case main body 8 with the other end being fixed to a part of the undersurface of the pedal 4, the part being situated in front of the pedal supporting portion 10. Similarly to the second embodiment, such a configuration allows the spring 48 to exert the reaction force which linearly grows according to the amount of displacement of the pedal 4.

The spring 48 is placed between the case lid 9 and the flange portion 49 in the second embodiment, while the spring 48 is placed between the bottom of the frame main body 21 and the undersurface of the front part of the pedal supporting portion 10 of the pedal 4 in the third embodiment. However, the present invention is not limited to these arrangements. More specifically, the spring 48 may be placed anywhere as long as the reaction force exerted on the pedal 4 grows with increasing amount of displacement of the pedal 4 from the initial position. Although the spring 48 is employed as a reaction force producing member in the second embodiment and the third embodiment, the present invention is not limited to this configuration. Anything may be employed as the reaction force producing member as long as the reaction force exerted on the pedal 4 grows with increasing amount of displacement of the pedal 4 from the initial position. For instance, the spring 48 may be replaced with a massive body.

Furthermore, the above-described embodiments are mere representative embodiments of the present invention. Therefore, the present invention is not limited to the above-described embodiments. Namely, the present invention can be variously modified without departing from the scope of the present invention.

What is claimed is:

1. A pedal control apparatus of an electronic keyboard musical instrument, the pedal control apparatus comprising:

a pedal which is placed on a main body of the electronic keyboard musical instrument so that the pedal pivots about a fulcrum in accordance with a player's performance manipulation;

an action detecting means which detects an action of the pedal;

an actuator which exerts an external force on the pedal;

a control table storing means which stores different kinds of control tables in which action of the pedal is associated with external force exerted on the pedal by the actuator, wherein the external force associated with a certain action of the pedal varies among the control tables;

a table selecting means which selects one of the different kinds of control tables in accordance with a player's manipulation of setting operators; and a drive controlling means which obtains from the selected control table the external force associated with the detected action to drive and control the actuator in accordance with the obtained external force, wherein the obtained external force is exerted on the pedal according to the detected action of the pedal and concurrently with the player's performance manipulation of the pedal, and wherein the detected action includes a displacement and a velocity of the pedal; wherein the action detecting means determines based on the detected action whether the pedal is placed in an initial position, and different driving and controlling are performed based on depression or release of the pedal and in response to a determination that the pedal is not placed in the initial position.

2. A pedal control apparatus of an electronic keyboard musical instrument according to claim 1, wherein the control tables include external force associated with action of the pedal in a half pedal range interposed between an initial pedal depression range and a latter pedal depression range of an entire stroke range of the pedal, and the half pedal range exhibits a significant rate of change of reaction force produced on the pedal compared with the initial pedal depression range and the latter pedal depression range.

3. A pedal control apparatus of an electronic keyboard musical instrument according to claim 1, wherein the control tables include external force associated with action of the pedal in a half pedal range interposed between an initial pedal depression range and a latter pedal depression range of an entire stroke range of the pedal, and the half pedal range exhibits a significant rate of change of reaction force produced on the pedal compared with the latter pedal depression range.

4. A pedal control apparatus of an electronic keyboard musical instrument according to claim 1, wherein the setting operators manipulated by a player in order to select any one of the different kinds of control tables select a timbre of a musical tone signal emitted in accordance with manipulation of a keyboard of the main body of the electronic musical instrument.

5. A pedal control apparatus of an electronic keyboard musical instrument according to claim 1, wherein the different kinds of control tables stored in the control table storing means are supplied from a storage medium, different from the control table storing means, provided for the main body of the electronic keyboard musical instrument or supplied from an external storing means provided through a communications network.

6. A pedal control apparatus of an electronic keyboard musical instrument according to claim 1, the apparatus further comprising:

a spring which urges the pedal toward its initial position, wherein an external force is exerted on the pedal not only by the actuator but also by the spring.

7. A pedal control apparatus of an electronic keyboard musical instrument according to claim 1, wherein the external force is a reaction force to the pedal action.

8. A pedal control apparatus of an electronic keyboard musical instrument the pedal control apparatus comprising:

a pedal which is placed on a main body of the electronic keyboard musical instrument so that the pedal pivots about a fulcrum in accordance with a player's performance manipulation;

an actuator which exerts an external force on the pedal;

a memory which stores different kinds of control tables in which action of the pedal is associated with external force exerted on the pedal by the actuator, wherein the external force associated with a certain action of the pedal varies among the control tables; and a processor performing the steps of:

detecting an action of the pedal, selecting one of the different kinds of control tables in accordance with a player's manipulation of setting operators, obtaining from the selected control table the external force associated with the detected action, and driving and controlling the actuator in accordance with the obtained external force, wherein driving and controlling the actuator includes exerting the obtained external force on the pedal according to the detected action of the pedal and concurrently with the player's performance manipulation of the pedal; wherein the action detecting means determines based on the detected action whether the pedal is placed in an initial position, and different driving and controlling are performed based on depression or release of the pedal and in response to a determination that the pedal is not placed in the initial position, and wherein the detected action includes a displacement and a velocity of the pedal.

9. A pedal control apparatus of an electronic keyboard musical instrument according to claim 8, wherein the control tables include external force associated with action of the pedal in a half pedal range interposed between an initial pedal depression range and a latter pedal depression range of an entire stroke range of the pedal, and the half pedal range exhibits a significant rate of change of reaction force produced on the pedal compared with the initial pedal depression range and the latter pedal depression range.

10. A pedal control apparatus of an electronic keyboard musical instrument according to claim 8, wherein the control tables include external force associated with action of the pedal in a half pedal range interposed between an initial pedal depression range and a latter pedal depression range of an entire stroke range of the pedal, and the half pedal range exhibits a significant rate of change of reaction force produced on the pedal compared with the latter pedal depression range.

11. A pedal control apparatus of an electronic keyboard musical instrument according to claim 8, wherein the setting operators manipulated by a player in order to select any one of the different kinds of control tables select a timbre of a musical tone signal emitted in accordance with manipulation of a keyboard of the main body of the electronic musical instrument.

12. A pedal control apparatus of an electronic keyboard musical instrument according to claim 8, wherein the different kinds of control tables stored in the memory are supplied from a storage medium, different from the memory, provided for the main body of the electronic keyboard musical instrument or supplied from an external storing means provided through a communications network.

13. A pedal control apparatus of an electronic keyboard musical instrument according to claim 8, the apparatus further comprising:

a spring which urges the pedal toward its initial position, wherein an external force is exerted on the pedal not only by the actuator but also by the spring.

14. A pedal control apparatus of an electronic keyboard musical instrument according to claim 8, wherein the processor further performs the step of determining based on the detected action whether the pedal is placed in an initial position, wherein the driving and controlling are performed in response to a determination that the pedal is not placed in the initial position.

15. A pedal control apparatus of an electronic keyboard musical instrument according to claim 8, wherein the external force is a reaction force to the pedal action.

* * * * *